US008136517B2

(12) United States Patent
Atkinson et al.

(10) Patent No.: US 8,136,517 B2
(45) Date of Patent: Mar. 20, 2012

(54) REMOTE OVEN VALVE ACTUATOR

(75) Inventors: Wade A. Atkinson, Ooltewah, TN (US); Christopher A. Larsen, Cleveland, TN (US)

(73) Assignee: Whirlpool Corporation, Benton Harbor, MI (US)

( * ) Notice: Subject to any disclaimer, the term of this patent is extended or adjusted under 35 U.S.C. 154(b) by 559 days.

(21) Appl. No.: 12/334,975

(22) Filed: Dec. 15, 2008

(65) Prior Publication Data

US 2010/0147283 A1 Jun. 17, 2010

(51) Int. Cl.
*F24C 3/12* (2006.01)

(52) U.S. Cl. ..... 126/39 R; 126/39 E; 126/39 G; 126/42; 431/91; 431/255; 137/66; 251/231; 251/233

(58) Field of Classification Search ..... 126/39 R, 126/42, 39 E, 39 G; 431/255, 191; 137/66; 251/231, 233
See application file for complete search history.

(56) References Cited

U.S. PATENT DOCUMENTS

| | | | | |
|---|---|---|---|---|
| 1,943,490 | A * | 1/1934 | Schuck et al. | 236/1 H |
| 2,069,278 | A * | 2/1937 | Sackett | 236/15 A |
| 2,597,266 | A * | 5/1952 | Sherman | 126/39 E |
| 2,741,261 | A * | 4/1956 | Weissenborn | 137/486 |
| 2,896,704 | A * | 7/1959 | Alewald | 431/255 |
| 3,664,323 | A * | 5/1972 | Michaels | 126/42 |
| 5,640,946 | A * | 6/1997 | Oslin | 126/20 |
| 5,954,045 | A | 9/1999 | Bhanot | |
| 6,192,913 | B1 | 2/2001 | Willey et al. | |
| 6,957,657 | B2 * | 10/2005 | Choinard | 137/66 |

* cited by examiner

*Primary Examiner* — Steven B McAllister
*Assistant Examiner* — Avinash Savani
(74) *Attorney, Agent, or Firm* — Barnes & Thornburg, LLP

(57) ABSTRACT

A gas cooking range includes a housing having an upper half section and a lower half section. A gas control valve is operable to control the flow of gas to a burner. The gas control valve is positioned in the lower half section of a housing of the gas cooking range. A handle extending from the gas control valve to the upper half section of the housing is operable to control the gas control valve.

14 Claims, 3 Drawing Sheets

REMOTE OVEN VALVE ACTUATOR

TECHNICAL FIELD

The present disclosure relates generally to cooking ranges and more particularly to gas cooking ranges with gas control devices.

BACKGROUND

A gas cooking range is used to cook meals and other foodstuffs on a cooking surface or within an oven. Natural gas or propane fuel is used to create a controlled flame that generates the heat necessary for cooking. Ranges typically include various control valves and electronics to regulate the flow of gas.

SUMMARY

According to one aspect, a gas cooking range is disclosed. The gas cooking range may include a lower frame having a number of downwardly extending legs configured to contact a floor, a gas burner, and an upper panel including a control interface operable to control the operation of the gas burner. The gas cooking range may also include a housing extending from the lower frame to the upper panel. The housing is divided into an upper half section and a lower half section by a laterally extending imaginary bisecting line. The gas cooking range also may include a gas control valve mounted to the lower half section of the housing. The gas control valve is operable to control the flow of gas to the gas burner. The gas cooking range may have a handle assembly having a first end positioned in the upper half section and a second end coupled to the gas control valve. The handle assembly is operable to control the gas control valve.

In some embodiments, the gas cooking range may also include an oven where the gas burner is operable to heat the oven. In some embodiments, the gas cooking range may include a handle assembly having a shaft and a lever. The shaft has a first end positioned in the upper half section and a second end positioned in the lower half section, the lever is secured to both the second end of the shaft and the gas control valve, and the shaft is operable to move the lever between a first position and a second position.

In some embodiments, the gas cooking range may include a gas control valve that is positioned in an open valve position when the lever is positioned in the first position and positioned in a closed valve position when the lever is positioned in the second position. Additionally, in some embodiments, the gas cooking range may include a gas pressure regulator having an inlet port. The gas control valve has an outlet port, the gas control valve is coupled to the gas pressure regulator, and the inlet port of the regulator is fluidly coupled to the outlet port of the gas control valve when the gas control valve is in the open valve position.

In some embodiments, the gas cooking range may include a housing having a front and a back. The control interface of the upper panel is positioned above the front of the housing, and the gas control valve is mounted to the lower half section of the back of the housing. In some embodiments, the gas cooking range may have a first end of the shaft positioned in the upper half section of the back of the housing. Additionally, in some embodiments, the gas cooking range may have the handle assembly further including a grip secured to the first end of the shaft. In some embodiments, the gas cooking range may include the grip positioned behind the control interface of the upper panel, and the grip is accessible from the front of the housing by reaching over the control interface. In some embodiments, the gas cooking range may include a first cooking chamber, which includes a first gas burner operable to heat the first cooking chamber, and a second cooking chamber, which includes a second gas burner operable to heat the second cooking chamber.

According to another aspect, the gas cooking range may include a lower frame having a number of downwardly extending legs configured to contact a floor, a housing extending upwardly from the lower frame, the housing divided into an upper half section and a lower half section by a laterally extending imaginary bisecting line, and an oven secured to the housing. The gas cooking range also may include a gas burner operable to heat the oven and an upper panel secured to the housing. The upper panel includes a control interface operable to control the operation of the gas burner. The gas cooking range may include a gas control valve mounted to the lower half section of the housing, and the gas control valve may be operable to control the flow of gas to the gas burner. The gas cooking range may also include a handle assembly having a first end positioned in the upper half section and a second end coupled to the gas control valve. The handle assembly is operable to control the gas control valve.

In some embodiments, the gas cooking range may include a handle assembly having a shaft and a lever. The shaft has a first end positioned in the upper half section and a second end positioned in the lower half section, the lever is secured to both the second end of the shaft and the gas control valve, and the shaft is operable to move the lever between a first position and a second position. In some embodiments, the gas cooking range may include a gas control valve that is positioned in an open valve position when the lever is positioned in the first position and positioned in a closed valve position when the lever is positioned in the second position.

In some embodiments, the gas cooking range may further include a gas pressure regulator having an inlet port. The gas control valve has an outlet port, the gas control valve is coupled to the gas pressure regulator, and the inlet port of the regulator is fluidly coupled to the outlet port of the gas control valve when the gas control valve is in the open valve position. In some embodiments, the gas cooking range may have a housing having a front and a back. The control interface of the upper panel is positioned above the front of the housing, and the gas control valve is mounted to the lower half section of the back of the housing.

In some embodiments, the gas cooking range may include a first end of the shaft positioned in the upper half section of the back of the housing.

According to another aspect, the gas cooking range may include a lower frame having a number of downwardly extending legs configured to contact a floor, a first oven, a second oven, a first gas burner operable to heat the first oven, and a second gas burner operable to heat the second oven. The gas cooking range also may include an upper panel including a control interface. The control interface is operable to control the first gas burner and the second gas burner. The gas cooking range may also include a housing extending upwardly from the lower frame to the upper panel. The housing is divided into an upper half section and a lower half section by a laterally extending imaginary bisecting line. The gas cooking range may also include a gas control valve mounted to the lower half section of the housing. The gas control valve is operable to control the flow of gas to the first gas burner and the second gas burner. The gas cooking range may also include a handle assembly having a first end positioned in the upper half section and a second end coupled to the gas control valve. The handle is operable to control the gas control valve.

In some embodiments, the gas cooking range may include a handle assembly having a shaft and a lever. The shaft has a first end positioned in the upper half section and a second end positioned in the lower half section, the lever is secured to both the second end of the shaft and the gas control valve, and the shaft is operable to move the lever between a first position and a second position. In some embodiments, the gas cooking range may include a gas control valve that is positioned in an open valve position when the lever is positioned in the first position and positioned in a closed valve position when the lever is positioned in the second position.

BRIEF DESCRIPTION OF THE DRAWINGS

The detailed description particularly refers to the following figures, in which.

DETAILED DESCRIPTION OF THE DRAWINGS

Figure 1:
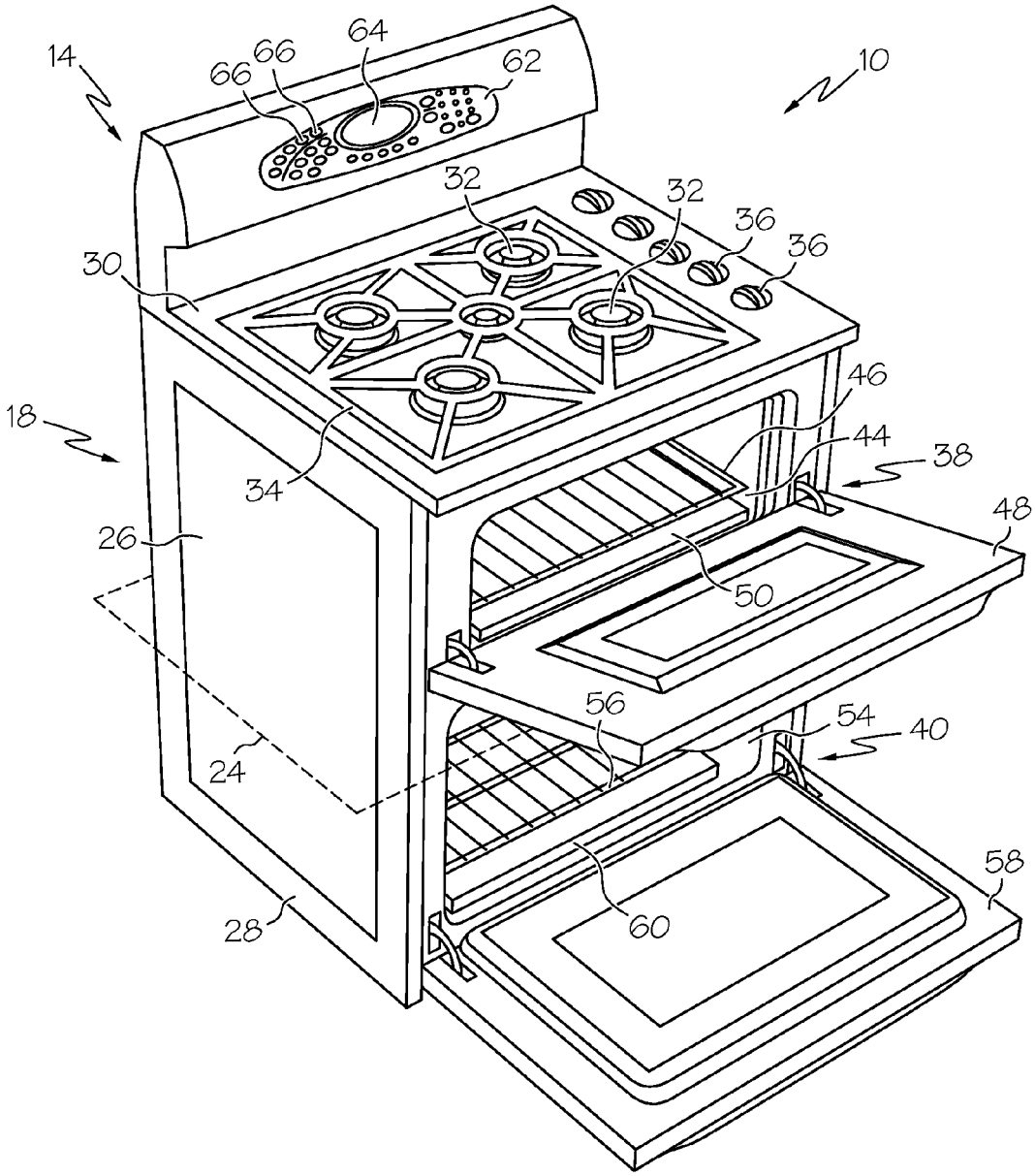
FIG. 1 is a perspective view of a gas cooking range.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the invention as defined by the appended claims.

Figure 2:
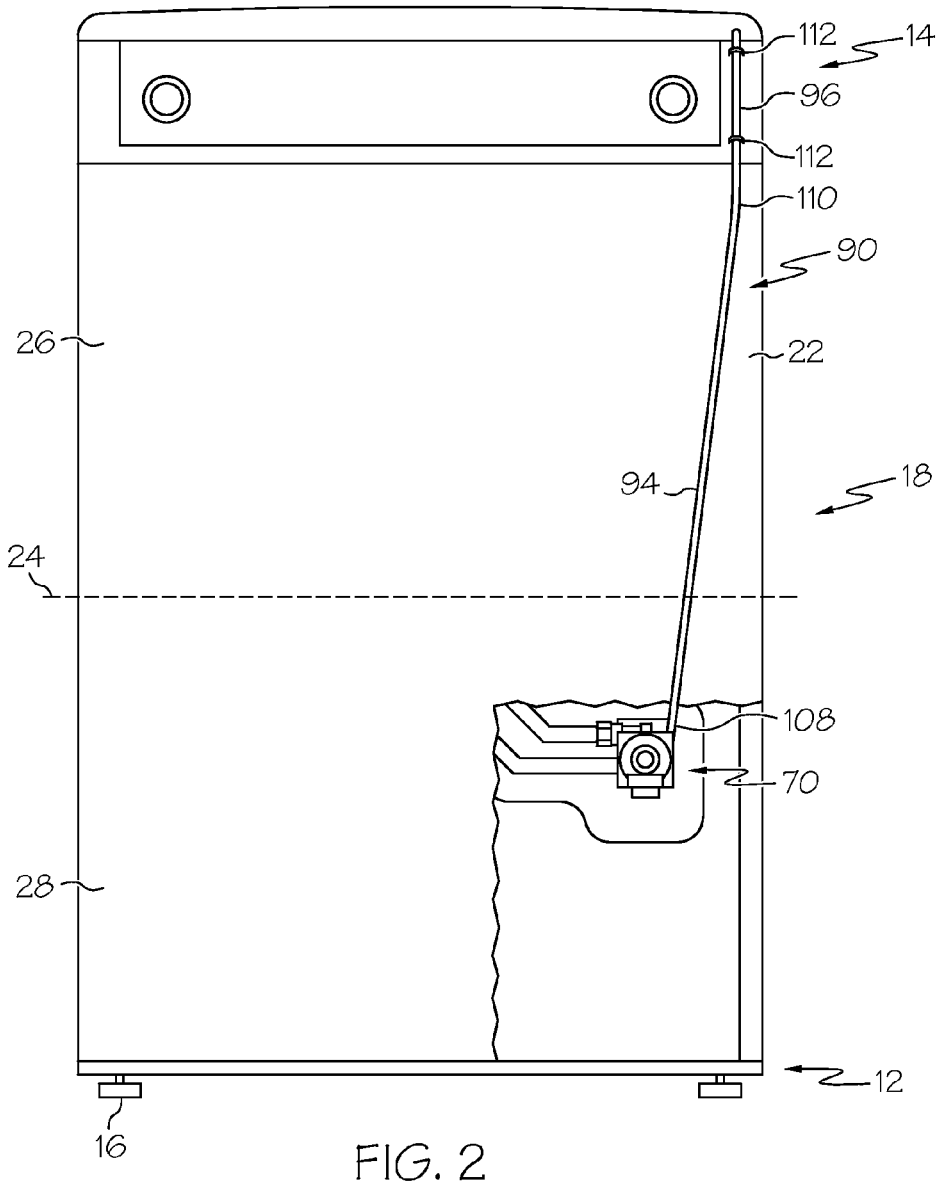
FIG. 2 is a rear elevation view of the gas cooking range of FIG. 1; and, FIG. 3 is a fragmentary perspective view of the gas control valve of the gas cooking range of FIG. 1.

Referring to FIGS. 1 and 2, a gas cooking range assembly 10 (hereinafter range 10) includes a lower frame 12 and an upper panel 14. As best seen in FIG. 2, the lower frame 12 includes a number of downwardly extending legs 16 configured to contact a floor of a house (not shown). The legs 16 are located in each corner of the lower frame and are adjustable to allow the user to level the gas cooking range 10 to compensate for any tilt or angle of the floor.

A housing 18 extends upwardly from the lower frame 12 to the upper panel 14. As shown in FIG. 2, a back panel 22 covers the internal gas lines and electronics (not shown) of the range 10. A laterally extending imaginary plane 24 bisects the housing 18 into an upper half section 26 and a lower half section 28. The upper half section 26 has a cooking surface 30 secured thereto. The cooking surface 30 has a number of gas burners 32 (see FIG. 1). Each of the gas burners 32 has a burner grate 34 positioned above it. The gas burners 32 are configured to generate controlled flames that may be used to heat cooking utensils (i.e., pots and pans) placed on the grates 34. The burners 32 and grates 34 are arranged on the cooking surface 30 such that a user can simultaneously heat pots, pans, skillets, and the like.

The magnitude of the flame generated by the burners 32 is proportionate to the amount of gas flowing to the burners 32. A user may adjust the flow of gas to the burners 32 using a set of knobs 36 that are positioned on the cooking surface 30 proximate to the gas burners 32. As the user rotates each of the knobs 36, a gas control valve (not shown) changes the amount of gas flowing to the corresponding burner 32.

An upper oven 38 and a lower oven 40 are accessible from the front of the housing 18. The oven 38 has a cooking chamber 44 into which pans, sheets, or other cookware carrying food are placed to be heated. The cooking chamber 44 includes a number of racks 46 located therein. A door assembly 48 is hinged to the front of the housing 18 and permits access to the cooking chamber 44. A gas-fired bake burner 50 with its associated cover is located below the rack 46. The bake burner 50 is configured to provide heat for baking or otherwise cooking food items in the cooking chamber 44.

The lower oven 40 has a configuration similar to that of the upper oven 38. The lower oven 40 has cooking chamber 54 into which pans, sheets, or other cookware carrying food are placed to be heated. The cooking chamber 54 includes a number of racks 56 located therein. A door assembly 58 is hinged to the front of the housing 18 and permits access to the cooking chamber 54. A gas-fired bake burner 60 with its associated cover is located below the rack 56. The bake burner 60 is configured to provide heat for baking or otherwise cooking food items in the cooking chamber 54.

A user may control the operation of the ovens 38, 40 using a control interface 62 located on the upper panel 14. The control interface 62 includes a display 64 and a set of push buttons 66 that are connected to an automated control system (not shown) operable to control the operation of the ovens 38, 40. For example, the user may use the control interface 62 to set a desired temperature for each oven. The automated control system responds by igniting a flame with each of the bake burners 50, 60 and adjusting the flow of gas to the flames as necessary to heat the ovens 38, 40 to the desired temperatures. The amount of heat generated in the cooking chambers 44, 54 is proportionate to the amount of gas flowing to the bake burners 50, 60.

Figure 3:
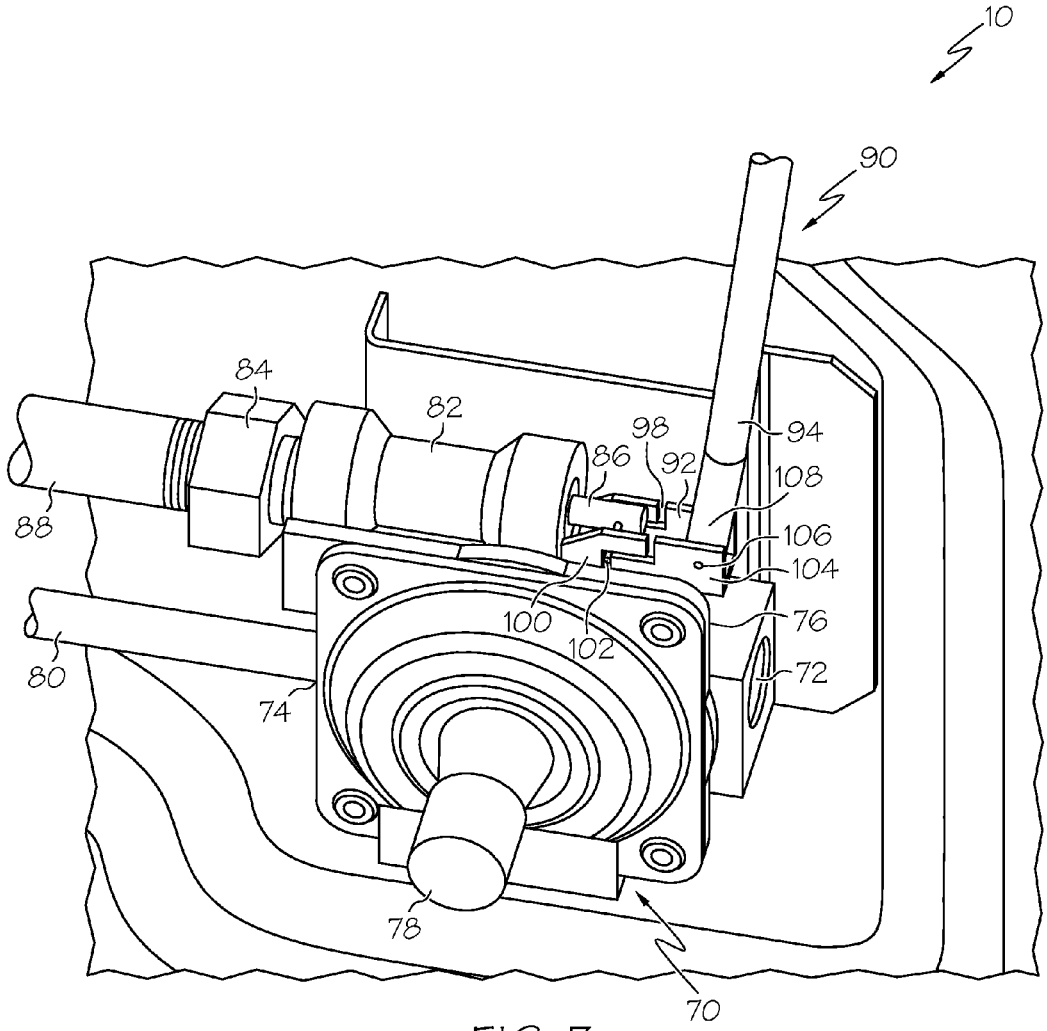

Referring to FIGS. 2 and 3, a gas pressure regulator 70 is mounted in the lower half section 28 of the range 10. The regulator 70 is configured to supply the flow of gas to the burners 32 located on the cooking surface 30 and the bake burners 50, 60 located in the ovens 38, 40. The regulator 70 includes a gas inlet port 72 configured to be coupled to a source of gas (not shown) such as a residential gas wall outlet. A regulator chamber 76 is positioned between the inlet port 72 to an outlet port 74. When the inlet port 72 is coupled to the source of gas, gas is advanced into the regulator chamber 76. A gas flow controller 78 is used to set the pressure of gas advanced through the regulator chamber 76 to the outlet port 74. Gas is delivered into a gas line 80 coupled to the gas outlet port 74 and advanced to the gas control valves (not shown) coupled to the burners 32 and operated by the knobs 36.

A gas control valve 82 is coupled to the regulator 70. The gas control valve 82 is configured to control the flow of gas to the bake burners 50, 60 in conjunction with the automated control system. While the automated control system is configured to control the flow of gas to the bake burners 50, 60 in response to inputs from the control interface 62, the user may manually close the gas control valve 82 and shutdown the flow of gas to the bake burners 50, 60. The gas control valve 82 has a valve member (not shown) positioned between the inlet port 72 of the regulator 70 and an outlet port 84.

An actuator rod 86 is coupled to the valve member and configured to move the valve member between an open valve position and a closed valve position. When the actuator rod 86 is placed in an extended position (see FIG. 3), the gas control valve 82 is moved to an open valve position thereby fluidly coupling the inlet port 72 to the outlet port 84. Gas is advanced through the inlet port 72 and outlet port 84 and is delivered into a gas line 88 coupled to the outlet port 84. Gas then advances through the gas line 88 to the bake burner valves (not shown) then to the bake burners 50, 60 under the control of the automated control system. Alternatively, when the actuator rod 86 is placed in a retracted position (not shown), the gas control valve 82 is moved to a closed valve position and gas is prevented from advancing from the inlet port 72 to the outlet port 84. In other words, the gas control valve 82 prevents gas from being available for use in the bake burners 50, 60.

The actuator rod 86 of the gas control valve 82 is moved between its two positions via a handle assembly 90. The handle assembly 90 extends from the lower half section 28 to the upper half section 26 of the housing 18 and includes a lever 92, a shaft 94, and a grip 96. The lever 92 has a slot 98 defined at an end 100. The actuator rod 86 is secured to the lever 92 via a pin 102 resting in the slot 98. It should be appreciated that in other embodiments other clips, threaded rods, or fasteners may be used to secure the actuator rod 86 to the handle assembly 90. The lever 92 is configured to pivot and move the pin 102 within slot 98 to change the position of the actuator rod 86.

The shaft 94 is secured to the lever 92 at an end 104 via a pin 106. It should be appreciated that in other embodiments other clips, threaded rods, or fasteners may be used to secure the lever 92 to the shaft 94. The lever 92 is rotated when the shaft 94 is moved between a lowered position and a raised position (not shown). As seen in FIGS. 2 and 3, when the shaft 94 is placed in the lowered position, the lever 92 is pivoted to position the actuator rod 86 in its extended position. As discussed above, gas may advance through the gas pressure regulator 70 and the gas control valve 82 from the inlet port 72 to the outlet port 84 when the actuator rod 86 is in its extended position.

The shaft 94 extends from its lower end 108, which is secured to the lever 92 and located in the lower half section 28 of the housing 18, to its upper end 110 located in the upper half section 26. The grip 96 is secured to the shaft 94 at its upper end 110. The grip 96 is moveable within a pair of guides 112 coupled to the upper panel 14. A user standing at the front of the housing 18 may access the grip 96 by reaching over the upper panel 14. The user may use the grip 96 to place the shaft 94 in the raised position or lowered position. As such, the user is able to override the automated control system's control of the flow of gas to the bake burners 50, 60 from the front of the housing 18. In other words, the user is able to manually shutdown the flow of gas to the bake burners 50, 60 from the front of the housing 18.

While the disclosure has been illustrated and described in detail in the drawings and foregoing description, such an illustration and description is to be considered as exemplary and not restrictive in character, it being understood that only illustrative embodiments have been shown and described and that all changes and modifications that come within the spirit of the disclosure are desired to be protected.

For example, in the illustrative embodiment, the handle assembly 90 extends from the lower half section 28 to the upper half section 26 of the housing 18. It should be appreciated that in other embodiments the handle assembly may extend from the back of the housing 18 to the front of the housing 18 such that the user is able to manually shutdown the flow of gas to the bake burners 50, 60 from the front of the housing 18.

There are a plurality of advantages of the present disclosure arising from the various features of the method, apparatus, and system described herein. It will be noted that alternative embodiments of the method, apparatus, and system of the present disclosure may not include all of the features described yet still benefit from at least some of the advantages of such features. Those of ordinary skill in the art may readily devise their own implementations of the method, apparatus, and system that incorporate one or more of the features of the present invention and fall within the spirit and scope of the present disclosure as defined by the appended claims.

The invention claimed is:

1. A gas cooking range comprising:

a lower frame having a number of downwardly extending legs configured to contact a floor, a gas burner, an upper panel including a control interface operable to control the operation of the gas burner, a housing extending from the lower frame to the upper panel, the housing divided into an upper half section and a lower half section by a laterally extending imaginary bisecting line, a gas control valve mounted to the lower half section of the housing, the gas control valve being operable to control the flow of gas to the gas burner, and a handle assembly operable to control the gas control valve, the handle assembly comprising (i) a lever positioned below the laterally extending imaginary bisecting line, the lever being pivotally coupled to the gas control valve and movable between a first position in which the gas control valve is positioned in a closed valve position and a second position in which the gas control valve is positioned in an open valve position, and (ii) a shaft having a first end positioned above the laterally extending imaginary bisecting line and a second end positioned below the laterally extending imaginary bisecting line, the second end of the shaft being pivotally coupled to the lever such that vertical movement of the shaft causes the lever to move between the first position and the second position wherein the lever is coupled to a valve actuator rod of the gas control valve such that the movement of the lever causes the valve actuator rod to extend or retract substantially horizontally to control the flow of gas.

2. The gas cooking range of claim 1, further comprising an oven, wherein the gas burner is operable to heat the oven.

3. The gas cooking range of claim 1, further comprising a gas pressure regulator having an inlet port, wherein:

the gas control valve has an outlet port, the gas control valve is coupled to the gas pressure regulator, and the inlet port of the regulator is fluidly coupled to the outlet port of the gas control valve when the gas control valve is in the open valve position.

4. The gas cooking range of claim 1, wherein:

the housing has a front and a back, the control interface of the upper panel is positioned above the front of the housing and the gas control valve is mounted to the lower half section of the back of the housing.

5. The gas cooking range of claim 1, wherein the handle assembly further includes a grip secured to the first end of the shaft.

6. The gas cooking range of claim 5, wherein:

the grip is positioned behind the control interface of the upper panel, and the grip is accessible from the front of the housing by reaching over the control interface.

7. The gas cooking range of claim 1, further comprising:

a first cooking chamber including a first gas burner operable to heat the first cooking chamber, and a second cooking chamber including a second gas burner operable to heat the second cooking chamber.

8. A gas cooking range comprising:

a lower frame having a number of downwardly extending legs configured to contact a floor, a housing extending upwardly from the lower frame, the housing being divided into an upper half section and a lower half section by a laterally extending imaginary bisecting line, an oven secured to the housing, the oven including a cooking chamber and a door pivotally coupled to a front side of the housing, a gas burner operable to heat the oven, an upper panel secured to the housing, the upper panel including a control interface positioned above the front side of the housing, the control interface being operable to control the operation of the gas burner, a gas control valve mounted to the lower half section of a back side of the housing, the gas control valve being operable to control the flow of gas to the gas burner, and a handle assembly comprising (i) a shaft located outside of the cooking chamber, the shaft having a first end positioned on the back side of the housing in the upper half section and a second end coupled to the gas control valve, and (ii) a grip secured to the first end of the shaft and positioned behind the upper panel, the grip being operable to vertically move the shaft to control the gas control valve by causing a valve actuator rod of the gas control valve to extend or retract substantially horizontally.

9. The gas cooking range of claim 8, wherein:

the handle assembly comprises a lever secured to both the second end of the shaft and the gas control valve, and the shaft is operable to move the lever between a first position and a second position.

10. The gas cooking range of claim 9, wherein the gas control valve is:

positioned in an open valve position in which gas is permitted to flow when the lever is positioned in the first position, and positioned in a closed valve position in which gas is prevented from flowing when the lever is positioned in the second position.

11. The gas cooking range of claim 10, further comprising a gas pressure regulator having an inlet port, wherein:

the gas control valve has an outlet port, the gas control valve is coupled to the gas pressure regulator, and the inlet port of the regulator is fluidly coupled to the outlet port of the gas control valve when the gas control valve is in the open valve position.

12. A gas cooking range comprising:

a lower frame having a number of downwardly extending legs configured to contact a floor, a first oven having a first cooking chamber, a second oven having a second cooking chamber, a first gas burner operable to heat the first oven, a second gas burner operable to heat the second oven, an upper panel including a control interface, the control interface being operable to control the first gas burner and the second gas burner, a housing extending upwardly from the lower frame to the upper panel, the housing having a front side and a back side positioned opposite the front side that is divided into an upper half section and a lower half section by a laterally extending imaginary bisecting line, a gas control valve mounted to the lower half section of the back side of the housing, the gas control valve being operable to control the flow of gas to the first gas burner and the second gas burner, and a handle assembly located outside of the first cooking chamber and the second cooking chamber, the handle assembly having a first end positioned in the upper half section of the back side of the housing and a second end coupled to the gas control valve, the handle assembly being moveable vertically to control the gas control valve by causing a valve actuator rod of the gas control valve to extend or retract substantially horizontally.

13. The gas cooking range of claim 12, wherein:

the handle assembly comprises a shaft and a lever, the shaft has a first end positioned in the upper half section and a second end positioned in the lower half section, the lever is secured to both the second end of the shaft and the gas control valve, and the shaft is operable to move the lever between a first position and a second position.

14. The gas cooking range of claim 13, wherein the gas control valve is:

positioned in an open valve position when the lever is positioned in the first position, and positioned in a closed valve position when the lever is positioned in the second position.

* * * * *